United States Patent [19]

Ledbetter

[11] Patent Number: 4,761,006

[45] Date of Patent: Aug. 2, 1988

[54] AIRCRAFT LANDING GAME

[76] Inventor: Ferman Ledbetter, 115 Lancaster Dr., St. Louis, Mo. 63105

[21] Appl. No.: 70,989

[22] Filed: Jul. 8, 1987

[51] Int. Cl.[4] ..... A63F 9/00

[52] U.S. Cl. ..... 273/1 GC; 272/31 R; 273/1 GE; 434/32

[58] Field of Search ..... 273/1 GA, 1 GB, 1 GC, 273/1 G, 1 GE, 366; 272/31; 446/229, 230, 30, 33; 434/32

[56] References Cited

U.S. PATENT DOCUMENTS

| | | | |
|---|---|---|---|
| 1,947,982 | 2/1934 | Gerhardt et al. | 434/32 |
| 2,819,900 | 1/1958 | Brackett | 273/366 X |
| 3,012,780 | 12/1961 | Friedman | 272/31 A X |
| 3,087,257 | 4/1963 | White | 434/32 X |
| 3,373,505 | 3/1968 | Tucker | 434/32 X |
| 3,476,386 | 11/1969 | Bart | 272/31 A |
| 3,691,669 | 9/1972 | Folson et al. | 434/32 X |
| 3,978,609 | 9/1976 | English | 434/32 X |
| 4,037,358 | 7/1977 | Rosenbaum | 446/229 X |

FOREIGN PATENT DOCUMENTS

| | | | |
|---|---|---|---|
| 928827 | 6/1947 | France | 434/32 |

OTHER PUBLICATIONS

Playthings, 2-1977, Jet Pilot Ad.

*Primary Examiner*—Paul E. Shapiro
*Attorney, Agent, or Firm*—William H. Wright

[57] ABSTRACT

An aircraft landing game apparatus (10) comprising a housing unit (11) having a first motorized unit (12) including a closed loop track member (24) operatively connected to a miniature airplane (13) which makes a circuit around a horizontally disposed elevated platform member (18); and a second motorized unit (14) including a moving surface unit (15) including a flexible belt member (31) which rotates about a horizontally disposed axis; wherein, the flexible belt member (31) is provided with a normally open circuit means (40) including an illumination element (41); whereby the miniature airplane (13) is adapted to engage a contact plate (45) on the circuit means (40) to activate the illumination means (41) representative of a proper simulated landing of the miniature airplane (13).

7 Claims, 2 Drawing Sheets

FIG. 4.
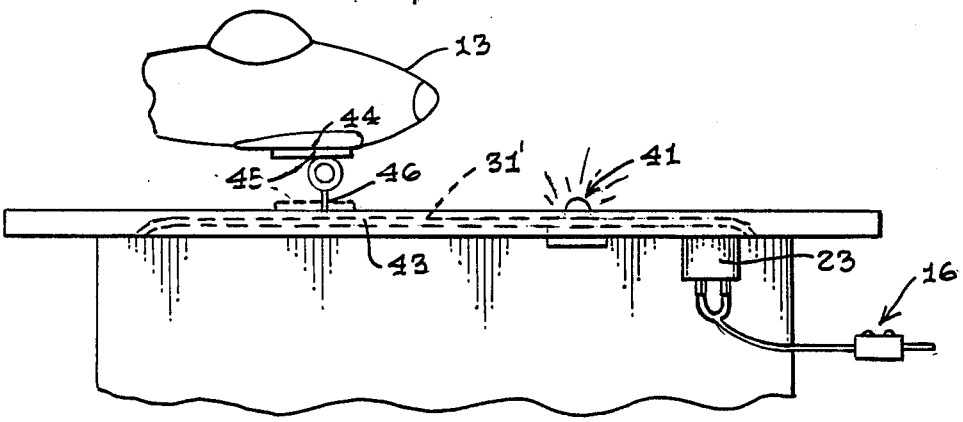
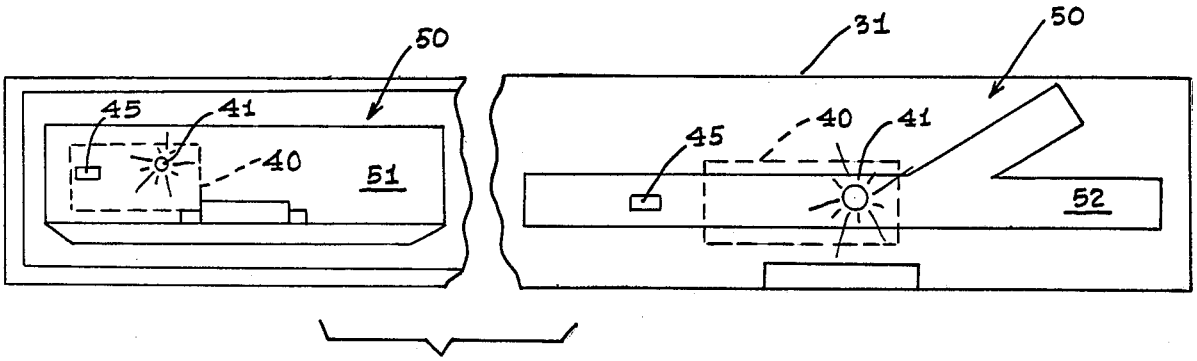
FIG. 5.

AIRCRAFT LANDING GAME

TECHNICAL FIELD

The present invention relates to the field of motorized games which simulate aircraft flight and landing functions.

BACKGROUND OF THE INVENTION

Even before the historic first manned flight by the Wright brothers at Kitty Hawk, N.C., the concept of flight had intrigued mankind down through the ages.

Once this concept had become a reality, the horizons of manned flight have expanded far beyond the wildest dreams of the original aviators, yet mankind's obsession with flight has remained unabated even to the present day.

As a consequence of the foregoing it should not come as a surprise that the patent literature is replete with myriad and diverse airplane flight simulators ranging from relatively simple mechanical game apparatus to the state of the art computer controlled simulators used to train pilots and astronauts.

Examples of some of the less complex prior art game devices may be seen by reference to the following U.S. Pat. Nos.: 3,373,505; 3,978,609; 3,691,669; and, 3,087,257. While all of the aforementioned patented structures are adequate from the standpoint of providing amusement and entertainment for the individuals employing them, the amount of enjoyment diminishes over a period of time as the player or players familiarize themselves with the operation of the controls and the repetitious results produced thereby.

As a result of the foregoing situation there has existed a long felt need for an airplane simulator game that would provide variable challenges to the users skill, reflexes, and coordination; thereby maintaining and prolonging the users interest level in the game.

SUMMARY OF THE INVENTION

The airplane simulator that forms the basis of the present invention comprises in general a first motorized unit that transports a miniature airplane at various heights around a closed loop track; and, a second motorized unit that is disposed parallel to a portion of the closed loop track, whereby the second motorized unit presents a continuously moving surface unit that will be contacted by the miniature airplane at least once during each of the airplanes revolutions about the closed loop track.

In addition, the moving surface unit is further provided with at least one normally open electrical circuit means operatively connected to an illumination unit; whereby, the selected contact between the miniature airplane and the moving surface unit will close the electrical circuit means to activate the illumination unit to indicate a successful simulated landing by the minature airplane.

Furthermore, both the first and second motorized units are provided with variable speed control units; whereby, the speed of the miniature airplane and the moving surface may be varied both individually and with respect to one another. This feature allows the user to become proficient at completeing succfessful simulated landings under a variety of different conditions, and these variable conditions will present new challenges for the player each time they play.

BRIEF SUMMARY OF THE DRAWINGS

These and other obejcts, advantages, and novel features of the invention will become apparent from the detailed description of the best mode for carrying out the preferred embodiment of this invention which follows; particularly when considered in conjunction with the accompanying drawings, wherein:

FIG. 4 is an enlarged detail view of the miniature airplane and the moving surface unit; and, FIG. 5 is a top plan view of the moving surface unit.

BEST MODE FOR CARRYING OUT THE INVENTION

Figure 1:
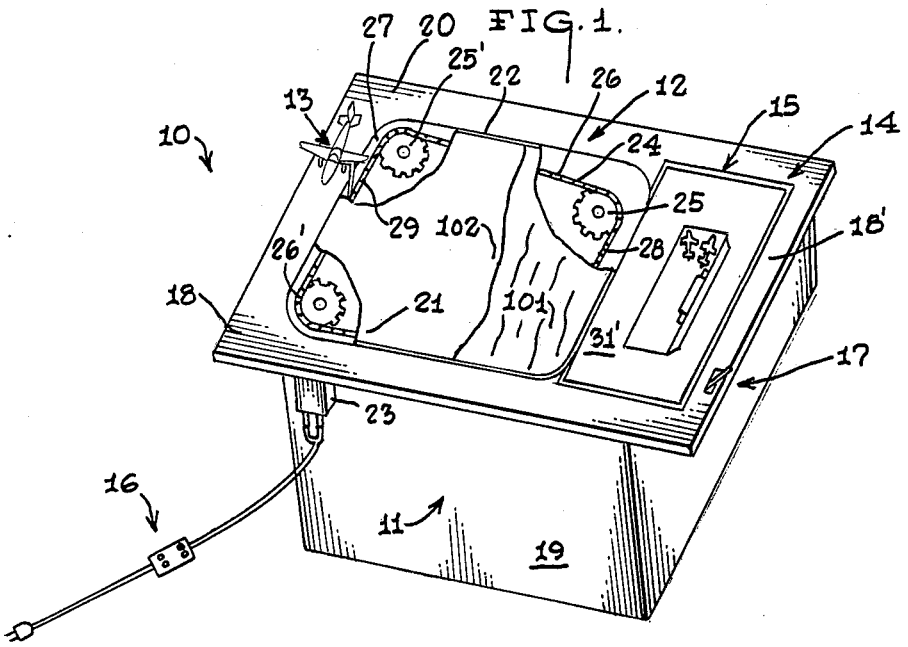
FIG. 1 is a perspective view of the aircraft landing game of this invention.

As can be seen by reference to the drawings and in particular to FIG. 1, the aircraft landing game apparatus that forms the basis of the present invention is designated generally by the reference numeral (10). The aircraft landing game apparatus (10) comprises in general: a housing unit (11); a first motorized unit (12) operatively attached to a miniature airplane (13); a second motorized unit (14) provided with a moving surface unit (15); and variable speed control units (16) and (17) operatively associated with the first (11) and second (14) motorized units. These units will now be described in seriatim fashion.

As shown in FIG. 1, the housing unit (11) comprises an elevated platform member (18) supported on a base member (19); wherein, the elevated platform member (18) is provided with an enlarged generally rectangular configuration. In addition, the enlarged elevated platform member (18) comprises an outer peripheral portion (20) which is spaced from and surrounds a self supported central insert member (21); wherein, the spacing between the outer peripheral portion (20) and the central insert member (21) forms a gap (22) whose purpose and function will be described presently.

Figure 2:
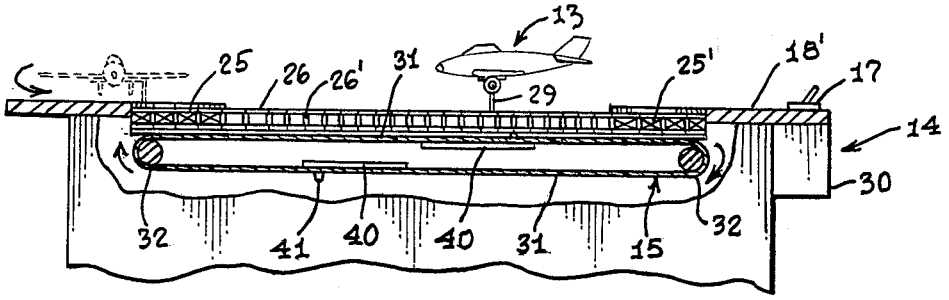
FIG. 2 is a cross-sectional view showing the relative orientation of the two motorized units.

As can best be seen by reference to FIGS. 1 and 2, the first motorized unit (12) is disposed within the base member (19) of the housing unit (11); and comprises a first variable speed motor (23) operatively connected to a closed loop track member (24). The closed loop track member (24) of the present invention comprises a plurality of drive elements (25) in the form of sprokets (25') which operatively engage a track element (26) in the form of a chain (26') which is joined into a closed loop, and rotates about a generally vertically disposed axis.

While a chain and sproket arrangement has been illustrated and described herein; it is to be understood that any suitable closed loop track member (24) such as a belt and pulley, or other suitable conveyor arrangement could be substituted therefore in keeping with the teachings of this invention.

It should also be noted that while different closed loop track members (24) may be used in conjunction with this invention, the track member (24) must be deployed adjacent the gap (22) in the elevated platform member (18) and in such a manner that one track segment (27) is disposed in close proximity and generally parallel to the elevated platform member (18); while the opposed track segment (28) is substantially spaced from and disposed generally parallel to the elevated platform member.

As can be seen by reference to FIGS. 1, 2, and 4, the operative connection between the miniature airplane (13) and the track member (24) comprises an inverted generally U-shaped-support member (29); wherein, the longer leg (29') of the support member (29) is connected to the track member (24) and the shorter leg (29'') of the support member (29) is connected to the miniature airplane (13).

In this manner, as the miniature airplane (13) traverses the circuit defined by the track member (24), the miniature airplane (13) will appear to: take-off; gain altitude; cruise; start to descend; and land relative to the horizontal plane of the elevated platform member (18). Furthermore, this sequence will be repeated for each revolution of the miniature airplane (13) around the central insert portion (21) of the elevated platform member (18).

As can best be appreciated by reference to FIGS. 1 and 2, the second motorized unit (14) comprises a second variable speed motor (30) which is operatively connected to a moving surface unit (15); wherein the moving surface unit (15) rotates about a generally horizontally disposed axis. In addition, the moving surface unit (15) comprises a generally wide closed loop flexible belt member (31) mounted on drive elements (32) which are operatively connected to the second variable speed (30).

Still referring to FIGS. 1 and 2, it can be seen that the moving surface unit (15) is disposed adjacent to the elevated platform member (18) such that the top surface (31') of the flexible belt member (31) is disposed parallel to, and in the same general horizontal plane as the top surface (18') of the elevated platform member (18).

Figure 3:
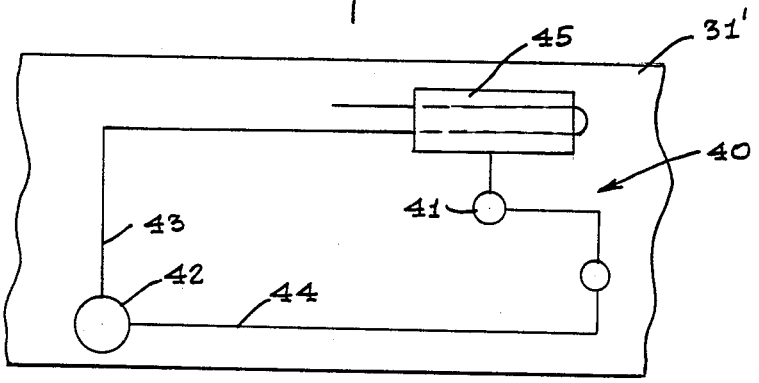
FIG. 3 is a schematic diagram of the circuit means.

Turning now to FIGS. 2 thru 4, it can be seen that the flexible belt member (31) of the moving surface unit (15) is provided with at least one normally open electrical circuit means (40) operatively connected to an illumination element (41). The normally open electrical circuit means (40) comprises a battery (42) having a positive lead (43) and a negative lead (44); wherein, the positive lead (43) rests on the top surface (31') of the flexible belt member (31). In addition, the negative lead (44) is normally spaced above the top surface of flexible belt member (31) by virtue of the negative lead (43) terminating in a generally flat contact plate (45) supported by an electrically conductive leg element (46); wherein, the conductive leg element (46) is electrically connected to the illumination element (41) in a well recognized fashion. Absent any outside force the illumination element will not be activated until the contact plate (45) is brought into enegagement with the opposed lead (43).

In the preferred embodiment of this invention depicted in FIGS. 2, 4, and 5, the flexible belt member (31) is provided with a plurality of normally open electrical circuit means (40). In addition, the plurality of circuit means (40) are disposed at spaced locations on the flexible belt member (31) and associated with indicia (50) representative of a suitable landing site for aircraft such as an aircraft carrier (51); an airport (52) or the like. Furthermore, each of the contact plates (45) are positioned at an appropriate location on the respective indicia (50) for a simulated aircraft landing.

As mentioned earlier on in the specification, both the first motorized unit (12) and the second motorized unit (14) are provided with respective variable speed control units (16) and (17) whereby the speed of each motorized unit (12)(14) may be varied in a well recognized manner, to change the speed between the miniature airplane (13) and the moving surface unit (15) relative to one another and to the elevated platform member.

Turning to FIGS. 2 and 4, it can be appreciated that the object of the aircraft landing game apparatus (10) is to manipulate the speed control unit (16) of the airplane (13) such that the airplane's speed will coincide with the pre-set speed of the indicia (50) on the moving flexible belt member (31), so as to bring the airplane (13) into engagement with the contact plate (45) to activate the illumination means (41).

While the placement of the indicia (50) at spaced locations on the flexible belt member (31), plus the provision of a variable speed control (17) for the moving surface unit (15) should present sufficient challenges for most players, this invention further contemplates the introduction of additional obstacles to the mastery of the apparatus (10).

Since the central insert member (21) must be self supported within the housing unit (11); it is further proposed to provide different portions of the insert member (21) with different indicia (101) and (102) which are compatible with the respective indicia (51) and (52) on the moving surface unit (15). In this manner credit for a proper simulated landing will only be given to the player if the landing is accomplished while the indicia on the moving surface unit (15) coincide with the indicia on the adjacent portion of the insert member (21). In addition, since the insert member must be self supported relative to the surrounding peripheral portion (20) of the elevated platform member (18), the orientation of the different indicia (101)(102) may be varied relative to the moving surface unit (15).

For example in the embodiment illustrated in FIG. 1, a 90° rotation of the insert members (21) in the clockwise direction would place the water indicia (101) ahead of the land indicica (102) relative to the direction of the moving surface unit; a 90° rotation of the embodiment depicted in FIG. 1 in the counterclockwise direction would place the land indicia (102) ahead of the water indicia (101); and, a 180° rotation in either direction would completely change the water indicia (101) over to the land indicia.

Having thereby disclosed the subject matter of the invention, it should be obvious that many substitutions, modifications, and additions are possible in light of the above teachings. It is therefore to be understood that the invention as taught and described herein is only to be limited to the extent of the breadth and scope of the appended claims.

I claim:

1. An aircraft landing game apparatus comprising:

a housing unit including a base member and an elevated platform member; wherein, the elevated platform member comprises a central insert member;

a first motorized unit including a closed loop track member operatively connected to a miniature airplane whereby the track member is disposed within the housing unit such that the miniature airplane will traverse a circuit around the said central insert member about a vertically disposed axis;

a second motorized unit including a moving surface unit comprising a closed loop belt member which revolves around a horizontally disposed axis; wherein, the top surface of the closed loop belt member is disposed adjacent to and in the same general plane as the elevated platform member, and the surface of the belt member is provided with at least one indicia representative of a suitable landing site for said miniature airplane.

2. An aircrft landing game apparatus as in claim 1 wherein, the closed loop track member of said first motorized unit has one track segment disposed in close proximity, and generally parallel, to said elevated platform member; and an opposed track segment which is substantially spaced from, and disposed generally parallel to, said elevated platform member.

3. An aircraft landing game apparatus as in claim 2; wherein, said first motorized unit is provided with a first variable speed control unit.

4. An aircraft landing game apparatus as in claim 3; wherein, said moving surface unit further includes:

at least one normally open circuit means operatively associated with an illumination element; wherein, said circuit means includes a contact plate supported above the moving surface unit.

5. An aircraft landing game apparatus as in claim 4; wherein, said second motorized unit is provided with a second variable speed unit.

6. An aircraft landing game apparatus as in claim 4; wherein, said at least one normally open circuit means is disposed at an appropriate location relative to said at least one indicia representative of a suitable landing site for said miniature airplane.

7. An aircraft landing game apparatus as in claim 4; wherein, the operative connection between said miniature airplane and said closed loop track member comprises a support member which is dimensioned to bring said miniature airplane into engagement with the contact plate of said circuit means to close said circuit means; when the said opposed segment of the track member bearing the support member and the top surface of the belt member bearing the circuit means are vertically aligned.

* * * * *